US005351722A

United States Patent [19]

Mamiliano

[11] Patent Number: 5,351,722

[45] Date of Patent: Oct. 4, 1994

[54] TETRAXIAL FABRIC AND WEAVING MACHINE FOR ITS MANUFACTURE

[75] Inventor: Dini Mamiliano, Milan, Italy

[73] Assignee: D.I.M.A. Ricerche Technologiche S.R.L., Drezzo, Italy

[21] Appl. No.: 168,582

[22] Filed: Dec. 16, 1993

Related U.S. Application Data

[63] Continuation of Ser. No. 958,959, Oct. 9, 1992, abandoned.

[30] Foreign Application Priority Data

Oct. 11, 1991 [IT] Italy ..... MI91 A 002697

[51] Int. Cl.[5] ..... D03D 13/00; D03D 41/00

[52] U.S. Cl. ..... 139/180; 139/DIG. 1; 139/11; 428/225

[58] Field of Search ..... 139/DIG. 1, 383 R, 11, 139/18, 384 R; 428/225

[56] References Cited

U.S. PATENT DOCUMENTS 3,999,578 12/1976 Kulczycki .
4,020,876 4/1988 Townsend et al. .
4,031,922 6/1977 Trost et al. ..... 139/18
4,170,249 10/1979 Trost ..... 139/11
4,438,173 3/1984 Trost ..... 139/DIG. 1
4,512,373 4/1985 Trost ..... 139/11

FOREIGN PATENT DOCUMENTS 0263392 4/1988 European Pat. Off. .
446368 12/1912 France .
2117418 12/1983 United Kingdom .

*Primary Examiner*—Andrew M. Falik
*Attorney, Agent, or Firm*—Merchant, Gould, Smith, Edell, Welter & Schmidt

[57] ABSTRACT

A tetraxial fabric and a weaving machine for manufacturing the fabric. The tetraxial fabric is formed by the crisscross of warp yarns, weft yarns, and bias yarns having two different diagonal directions. A first set of warp yarns is overlaid by the weft yarns and, in turn, overlies the bias yarns. A second set of warp yarns, which alternate with the warp yarns in the first set, overlies the weft yarns and is, in turn, overlaid by the bias yarns. Due to the yarn formation, the fabric has a constant isotropy and evenness and can be made with a fill coefficient of up to 100%. The weaving machine for the manufacture of the tetraxial fabric can alternately produce, in the fabric formation area, two sheds between the warp yarns for passing the weft yarns at opposite sides with respect to the bias yarns.

22 Claims, 12 Drawing Sheets

TETRAXIAL FABRIC AND WEAVING MACHINE FOR ITS MANUFACTURE

This is a continuation of application Ser. No. 07/958,959, filed Oct. 9, 1992, abandoned.

FIELD OF THE INVENTION

This invention relates to a tetraxial fabric and a weaving machine for the manufacture thereof.

BACKGROUND OF THE INVENTION

Known in the art is a so-called tetraxial fabric composed of warp yarns, weft yarns, first bias yarns and second bias yarns which crisscross each other, as well as the warp and weft yarns, along two different diagonal directions.

Such a fabric structure has nearly the same resistance to stretching in all directions, i.e. exhibits an isotropic behavior. By virtue of this property, it finds advantageous application to the making of tarpaulins, conveyor belts, inflatable boats plys, tire plys, sails, etc.

A tetraxial fabric as above is known from European Patent Application EP-0263392.

The tetraxial fabric disclosed in that European Patent Application is formed, however, with a weave which may ultimately result in loss of the above feature.

In fact, the weave geometry therein provides for no bonds between yarns, and the yarns are allowed to drift relative to one another into patches of low yarn density and higher yarn density across the fabric. The isotropic behavior and the eveness of the fabric will accordingly be downgraded.

Additionally, the disclosed weave can only produce fabrics having a fill coefficient below 50%, which forbids any compact fabric.

SUMMARY OF THE INVENTION

It is the object of this invention to obviate the drawbacks of the above-referenced prior art.

This object is achieved by a tetraxial fabric having warp yarns, weft yarns, first bias yarns and second bias yarns crisscrossing each other, and the warp and weft yarns, along two different diagonal directions. A first course of warp yarns is overlaid by the weft yarns and, in turn, overlies the first and second bias yarns. A second course of warp yarns, which alternate to the warp yarns in the first course, overlies the weft yarns and is, in turn, overlaid by the first and the second bias yarns.

For manufacturing the tetraxial fabric of this invention, a weaving machine is provided which comprises means for guiding the warp yarns toward a fabric formation area, and means for passing the weft yarns through the shed of warp yarns in said fabric formation area, and further comprises means for guiding the bias yarns in said fabric formation area such that said bias yarns cross each other and the warp and weft yarns along two different diagonal directions. The means for guiding the warp yarns comprise a first guide member for the first course of warp yarns and a second member guiding the second course of warp yarns in an offset fashion from the first course of warp yarns. The first and second guide members are provided at juxtaposed locations to each other and are movable each between a rearward position where their respective course of warp yarns locate to one side relative to the bias yarns and the other course of warp yarns and a forward position where their respective course of warp yarns locate to the opposite side from the bias yarns and the other course of warp yarns. Between the first course of warp yarns under the guiding action of the first guide member in the forward position and the second course of warp yarns under the guiding action of the second guide member in the rearward position is formed a first shed for one weft yarn. Between the first course of warp yarns under the guiding action of the first guide member in the rearward position and the second course of warp yarns under the guiding action of the second guide member in the forward position is formed a second shed for another weft yarn.

Described herein below by way of non-limitative examples are a tetraxial fabric according to the invention and two different weaving machines for making it, all illustrated by the accompanying drawings.

DESCRIPTION OF THE PREFERRED EMBODIMENTS

Figure 1:
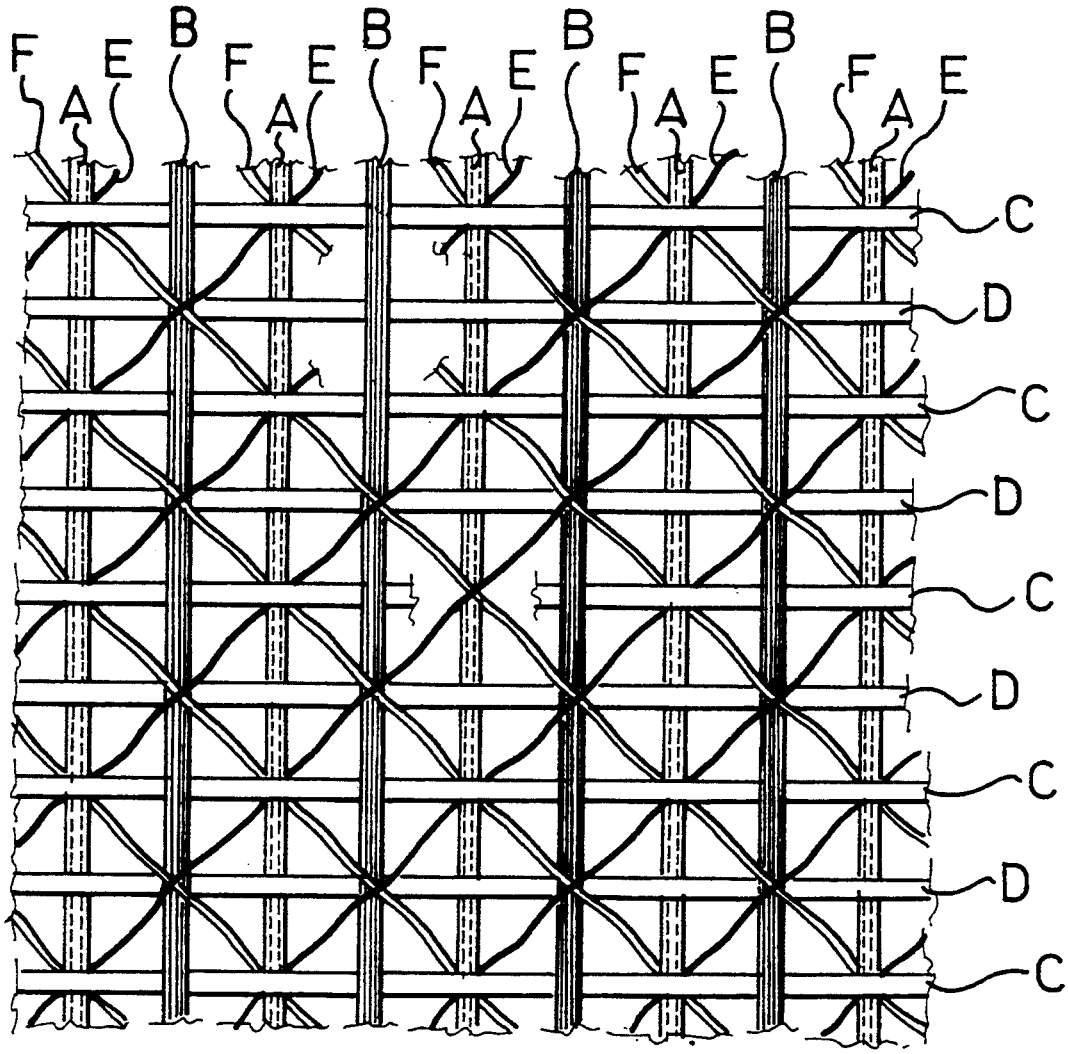
FIG. 1 is a plan view of the weave of a tetraxial fabric according to the invention.

The weave in FIG. 1 comprises a first set of odd-numbered warp yarns, indicated at A, which form a first course of warp yarns, and a second set of even-numbered warp yarns, indicated at B, which form a second course of warp yarns; all of the above warp yarns A, B lying parallel to one another. The weave in FIG. 1 further comprises weft yarns lying parallel to one another and being indicated at C where odd-numbered and D where even-numbered. Lastly, the weave comprises a first set of bias yarns lying parallel to one another and being indicated at E, and a second set of bias yarns lying parallel to one another and being indicated at F.

The warp yarns A, B cross the weft yarns C, D orthogonally. The bias yarns E and bias yarns F cross the warp yarns A, B and weft yarns C, D diagonally along two respective diagonal directions having opposite inclinations; in the example shown, the bias yarn sets E, F extend orthogonal to each other at an angle of 45° to the warp yarns A, B and the weft yarns C, D.

The crossovers of all said yarns locate at common crossover points. That is, at each crossover point there intersect one warp yarn, one weft yarn, one bias yarn from the first set of bias yarns, and one bias yarn from the second set of bias yarns.

The layout of said yarns is such that the warp yarns A are overlaid by all the weft yarns C,D and, in turn, overlie both the bias yarns E and the bias yarns F. The warp yarns B overlie all the weft yarns C, D and are overlaid by both the bias yarns E and the bias yarns F.

Such a symmetrical arrangement of the yarns provides a secure bond therebetween effective to prevent undesired relative drifting of the yarns and, therefore, the formation of different density patches across the fabric. Thus, the fabric will exhibit isotropic behavior under stretch and an even texture.

This symmetrical arrangement also has the advantage of imposing no limitations on the spacing of the yarns, thereby affording a fill coefficient of up to 100%, i.e. a fabric showing no gaps between yarns.

Figure 2:
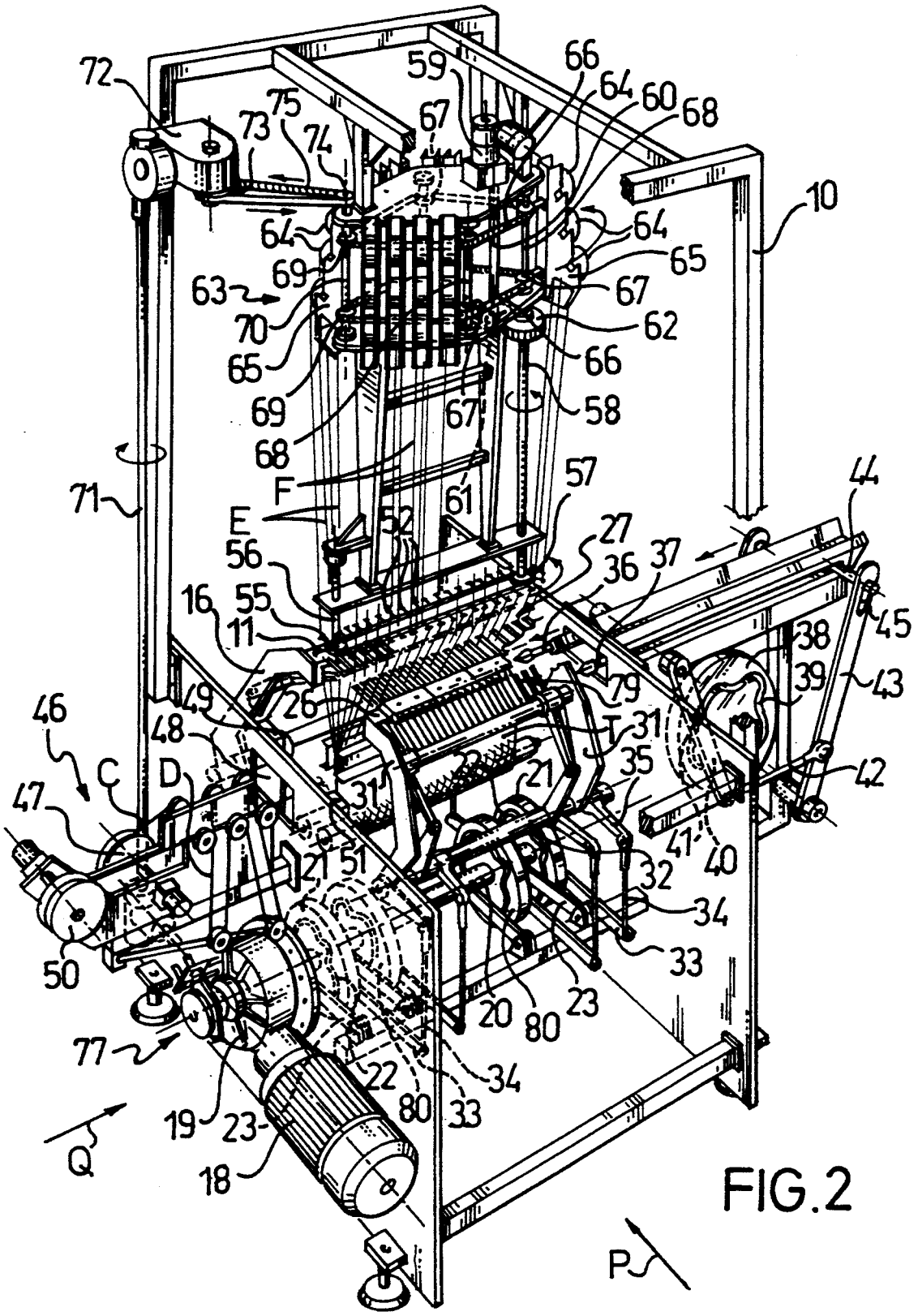
FIG. 2 is a perspective view of a weaving machine for making the tetraxial fabric in FIG. 1.
Figure 3:
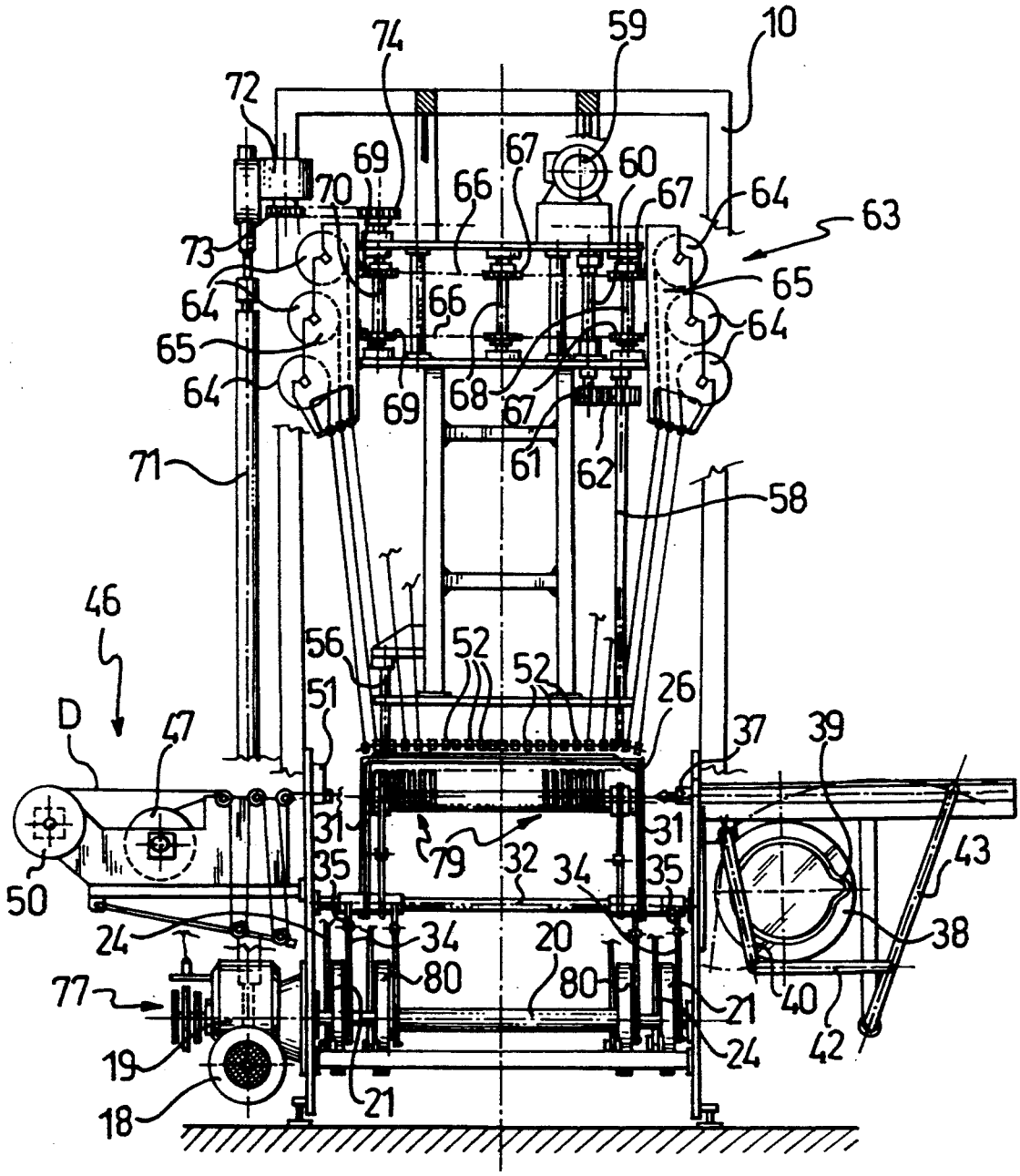
FIG. 3 is a front view of the weaving machine taken in the direction of arrow P in FIG. 2.

The machine in FIG. 2, intended for manufacturing the fabric of FIG. 1, comprises a bearing structure 10 on which the machine components are mounted, in particular means for guiding the warp yarns A, B toward a fabric formation area, means for passing the weft yarns C, D through the shed of the warp yarns A, B in said fabric formation area, and means for guiding the bias yarns E, F toward said fabric formation area.

The guide means for the warp yarns A, B comprise a first guide member for the warp yarns A and a second guide member for the warp yarns B; these two members are mounted to face each other.

Figure 4:
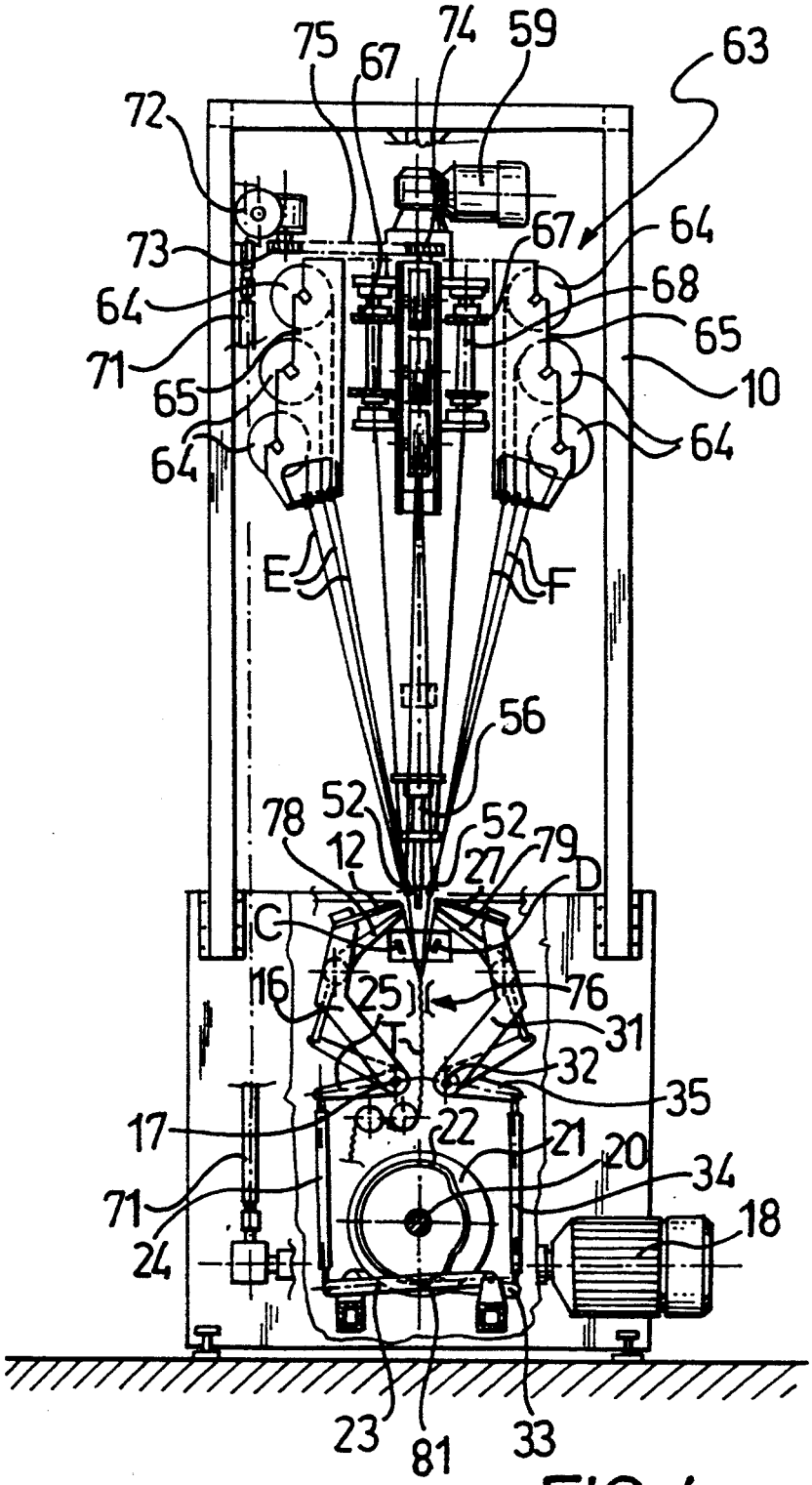
FIG. 4 is a side view of the weaving machine taken in the direction of arrow Q in FIG. 2.

The guide member for the warp yarns A comprises a holder bar 11 carrying a set of needles 12 parallel to one another. Each needle 12 has a hole 13 through which a respective warp yarn A is passed; the warp yarns A passed through the holes 13 extend from a set of reels 14 carried on a creel 15. The holder bar 11 is mounted on the ends of two side arms 16 which are connected to a shaft 17 with the other ends. The bar 11 with the needles 12 is reciprocated rotatively about the shaft 17 to move the holes 13 of the needles 12 between a position G and a position G' shown in FIG. 5. Power is provided by a main electric motor 18 rotating a shaft 20 through a drive unit 19; the shaft 20, in turn, rotates two wheels 21 mounted thereto; each of the two opposite sides of each wheel 21 is formed with an endless camming groove 22; two levers 23 pivoted with one end on the stationary portion of the machine are provided, at intermediate locations thereon, with two respective pins (of which one is shown at 81 in FIG. 4) which engage in two respective grooves 22, each on a respective wheel 21, such that the rotation of the wheels 21 will reciprocate the levers 23 rotatively about their pivot centers; the rotary reciprocation of each lever 23 is transferred to the shaft 17 through a rod 24 and a lever 25, and transmitted from the shaft 17 to the bar 11 through the arms 16.

The guide member for the warp yarns B is identical of the guide member for the warp yarns A, and accordingly, comprises a holder bar 26 holding a set of parallel needles 27. The needles 27 locate in front of the needles 12; additionally, these needles 27 are offset one pitch length from the needles 12. Each needle 27 has a hole 28 through which a respective warp yarn B is passed; the warp yarns B passed through the holes 28 extend from a set of reels 29 carried on a creel 30. The holder bar 26 is mounted on the ends of two side arms 31 connected, at the other ends, to a shaft 32. The bar 26 with the needles 27 is reciprocated rotatively about the shaft 32 such that the holes 28 in the needles 27 are moved between a position H and a position H', shown in FIG. 5. The bar 26 is reciprocated by means of the wheels 21, like bar 11. Two levers 33 are provided here which, similarly to the levers 23, are pivoted with one end on the stationary portion of the machine and provided with two respective pins; these pins engage in two more grooves 22 on the wheels 21 (that is, the two grooves 22 on the other sides of the wheels 21 not engaged by the pins 81 of the levers 23) such that the rotary movement of the wheels 21 will reciprocate the levers 33 rotatively about their pivot centers; the rotary reciprocation of each lever 33 is transferred to the shaft 32 through a rod 34 and a lever 35, and transmitted from the shaft 32 to the bar 26 through the arms 31.

The insertion means for the weft yarns C, D comprise two conventional telescoping pickers 36, 37 laid side-by-side and parallel to each other; picker 36 will insert the weft yarn C and picker 37 the weft yarn D. The two pickers 36, 37 are conventionally reciprocable linearly between retracted and extended positions, along a direction perpendicular to and underlying the needles 12 and 27; said pickers 36, 37 are driven by the same electric motor 18 which drives the guide means for the warp yarns; specifically, the motor 18 rotates a wheel 38 through drive means not shown; each of the two opposite sides of the wheel 38 is formed with an endless camming groove 39; for picker 37, there is a lever 40, pivoted with one end on the stationary portion of the machine, provided with a pin 41 which engages in either groove 39 such that the rotary motion of the wheel 38 will reciprocate the lever 40 rotatively about its pivot center; this rotary reciprocating motion is transferred, through a rod 42, to a further lever 43, also pivoted with one end on the stationary portion of the machine, which lever reciprocates the picker 37 linearly with the intermediary of a pin 44 sliding with one end in a slot 45 in the lever 43 and being connected to the picker 37 with the other end; the movement of the picker 36 is provided through similar drives, not shown, using the other groove 39 of the wheel 38.

Located opposite the pickers 36, 37 is a weft yarn C,D feeder unit, generally shown at 46, which feeds the weft yarn C to picker 36 and the weft yarn D to picker 37 in a conventional way. The weft yarn C, wound on a spool 47, is passed through an opening 48 and is picked up by the clamping head of the picker 36 with the latter in its fully extended position; as the picker 36, after picking up that yarn, is returned to its retracted position to insert the weft yarn C through the shed of the warp yarns A, B, a cutter mechanism 49 severs the weft yarn at the location of the opening 48, while the picker 36 on the opposite side releases the other end of the weft yarn. The same action takes place with the weft yarn D, picked up by picker 37; in this case, the weft yarn D is wound on a spool 50, and is severed by a cutter mechanism 51.

The guide means for the bias yarns E, F comprise a set of guide elements consisting of plates 52 attached to a chain 53, which extend in a plane overlying the needles 12 and 27. Each plate 52 has an eyelet 54 through which a respective bias yarn E, F is passed. The chain 53 is an endless chain wound around a sprocket wheel 55 rigid with an idler shaft 56, on the one side, and around a sprocket wheel 57 rigid with a shaft 58 driven rotatively by a step motor 59 through a shaft 60 and two gear wheels 61, 62, on the other side. Thus, the chain 53 will entrain the plates 52 stepwise around an elongate endless path having two straight sections and two circular arc sections interconnecting the two straight sections. The bias yarns going through the eyelets 54 in the plates 52 which locate along the straight section facing the holes 13 of the needles 12 in position G are bias yarns E whereas the bias yarns going through the eyelets 54 in the plates 52 which locate along the other straight section facing the holes 28 of the needles 27 in position H are bias yarns F.

In the upper portion of the machine, above the set of guide elements comprising the plates 52, there is a bias yarn E, F feeder unit including a carousel 63 which entrains sets of reels 64 in timed relationship to the movement of the underlying plates 52; a yarn extends from each reel 64 which is then passed through the eyelet 54 in a respective plate 52. In particular, the carousel 63 includes a set of box-type holder elements 65 on which three reels 64 are carried in a freely rotatable manner. The holder elements 65 are rigid with two chains 66 extending in two parallel planes which overlie each other; the chains 66 are wound each around three sprocket wheels 67 fitted on three respective idler shafts 68 and around a sprocket wheel 69 rigid with a shaft 70 driven rotatively by the electric motor 18 through various drives among which are a shaft 71, a drive unit 72, and two cogged pulleys 73, 74 with a cogged drive belt 75 therebetween. The path travelled by the chains 66 is substantially lozenge-like with the acute angles of the lozenge located at the circular arc sections of the underlying chain 53; thus, the reels 64 will be entrained by the carousel 63 around said lozenge-like path.

The operation of the machine for weaving the fabric shown in FIG. 1, discussed in the foregoing, will now be described.

Understandably, reference will be made to all the drawing figures showing the machine and its details, and particularly to FIG. 5 where the fabric formation area and the yarns involved in the process are more clearly visible.

Figure 5:
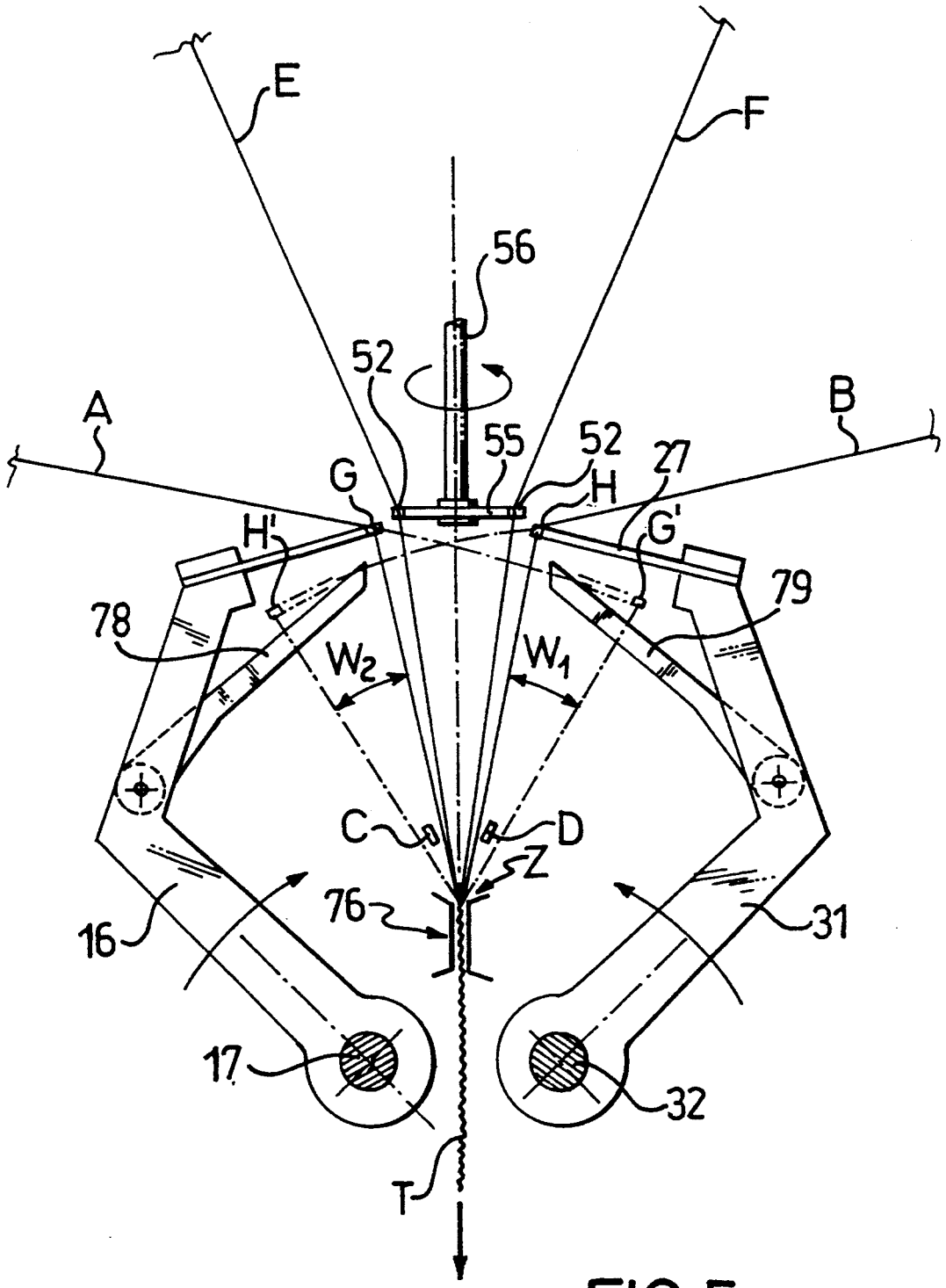
FIG. 5 is an enlarged detail view of FIG. 4.

Shown at Z in FIG. 5 is the start position of the fabric formed at a bar 76 to which all the woven yarns are run.

The sequential steps of the process are as follows:

needles 12 push the warp yarns A, guided in the holes 13, from position G to position G' through the set of bias yarns E, F, guided in the eyelets 54 of the plates 52, and through the warp yarns B, guided in the holes 28, held in position H, of the needles 27, thereby forming a shed W1 through which a weft yarn D is inserted by means of the picker 37;

needles 12 are returned to their original position with the holes 13 in position G and the warp yarns A, in moving from position G' to position G, tie the weft yarn D to the warp yarns B and the bias yarns F and E;

chain 53 moves forward one step and, accordingly, the bias yarns E move sideways one step in one direction, whereas the bias yarns F move sideways one step in the opposite direction, thereby the bias yarns E, F will cross each other;

needles 27 push the warp yarns B, guided in the holes 28, from position H to position H', through the bias yarns F, E and the warp yarns A, to form a second shed W2 through which a weft yarn C is inserted by means of the picker 36;

needles 27 are returned to their original position with the holes 28 in position H, and the warp yarns B, in moving from position H' to position H, tie the weft yarn C to the warp yarns A and the bias yarns E, F;

chain 53 moves forward another step and, accordingly, the bias yarns E move sideways another step in one direction, whereas the bias yarns F move sideways one step in the opposite direction, thereby the bias yarns E, F will cross each other at another point.

The weaving cycle just described is then repeated, and in this way, the fabric of FIG. 1 is obtained.

The formed fabric is denoted by T, and during the process cycle just described, is moved forward by a purposely provided sand roll of conventional design in the direction of the arrow in FIG. 5. This sand roll moves the fabric T forward of continuous motion at a rate which is suitably timed to the sequential movements reviewed above.

The above movements are all timed, for the needles 12 and 27, by the wheels 21 with the grooves 22, and for the pickers 36, 37, by the wheel 38 with the grooves 39, while for the chain 53 a conventional photocell device 77 is arranged to sense the angular position of the electric motor 18 shaft and send a corresponding electric signal to the step motor 59.

Figure 6:
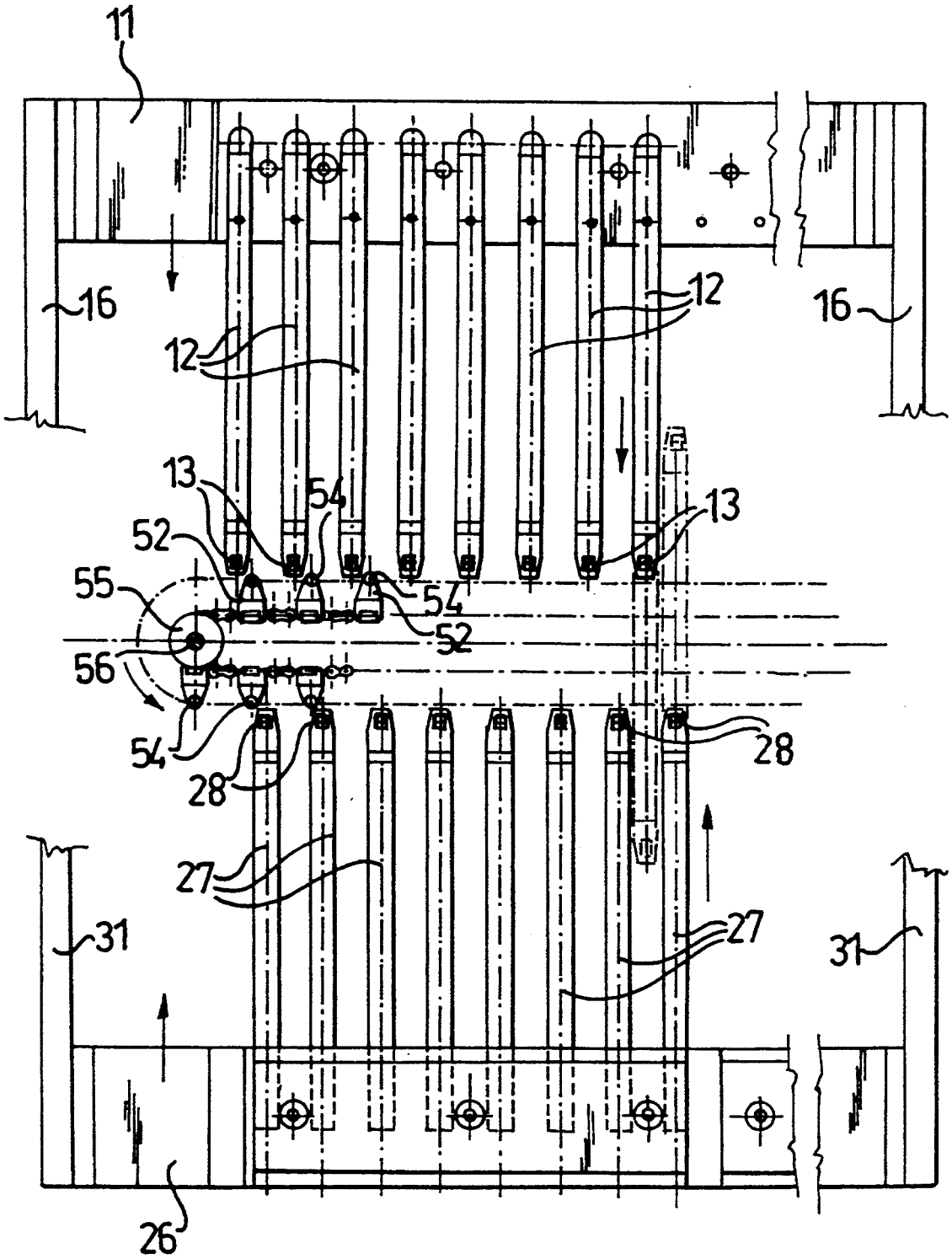
FIG. 6 is a top plan view of the detail shown in FIG. 5.
Figure 7:
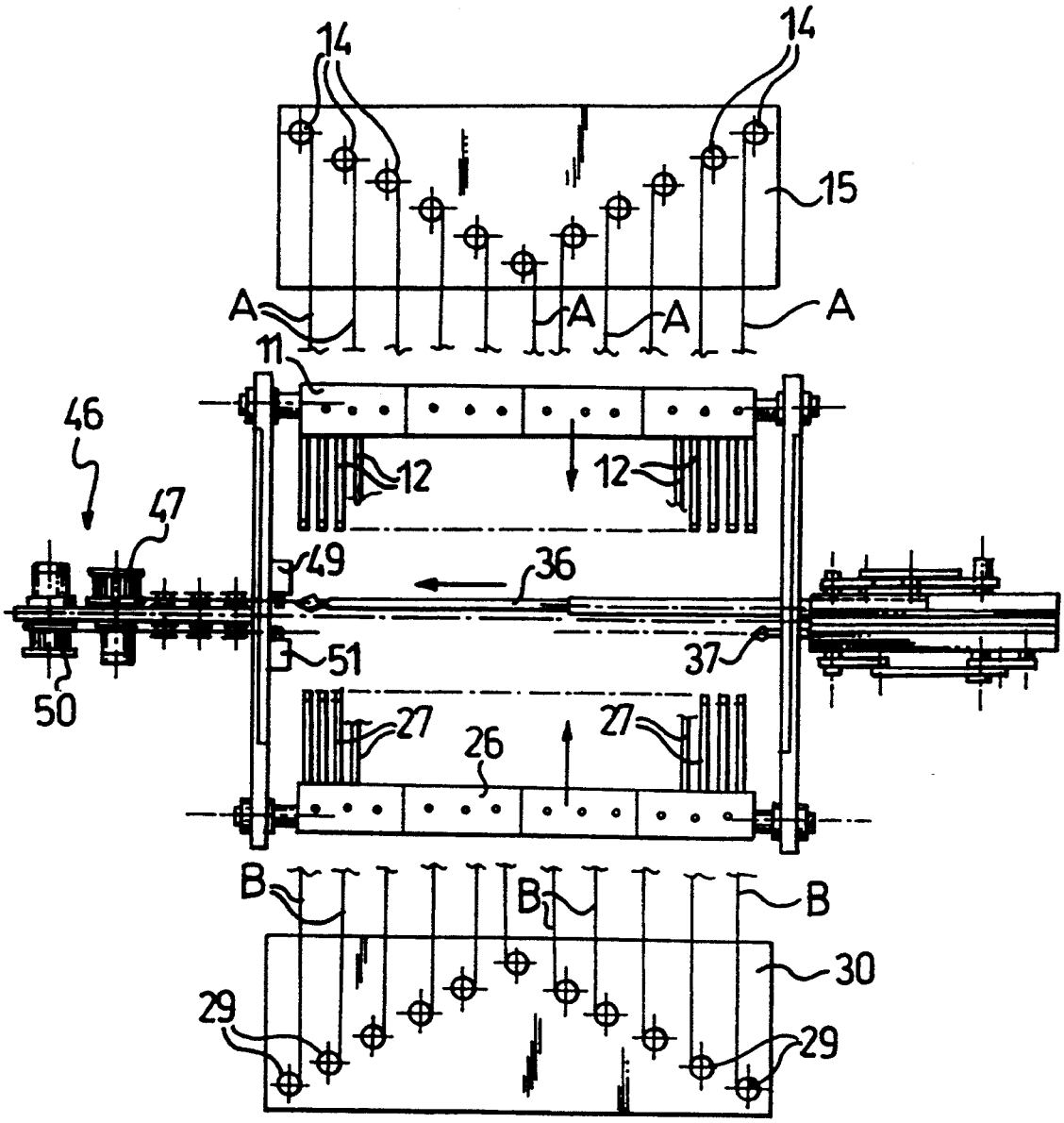
FIG. 7 is a top plan view of certain parts of the machine in FIG. 2.
Figure 8:
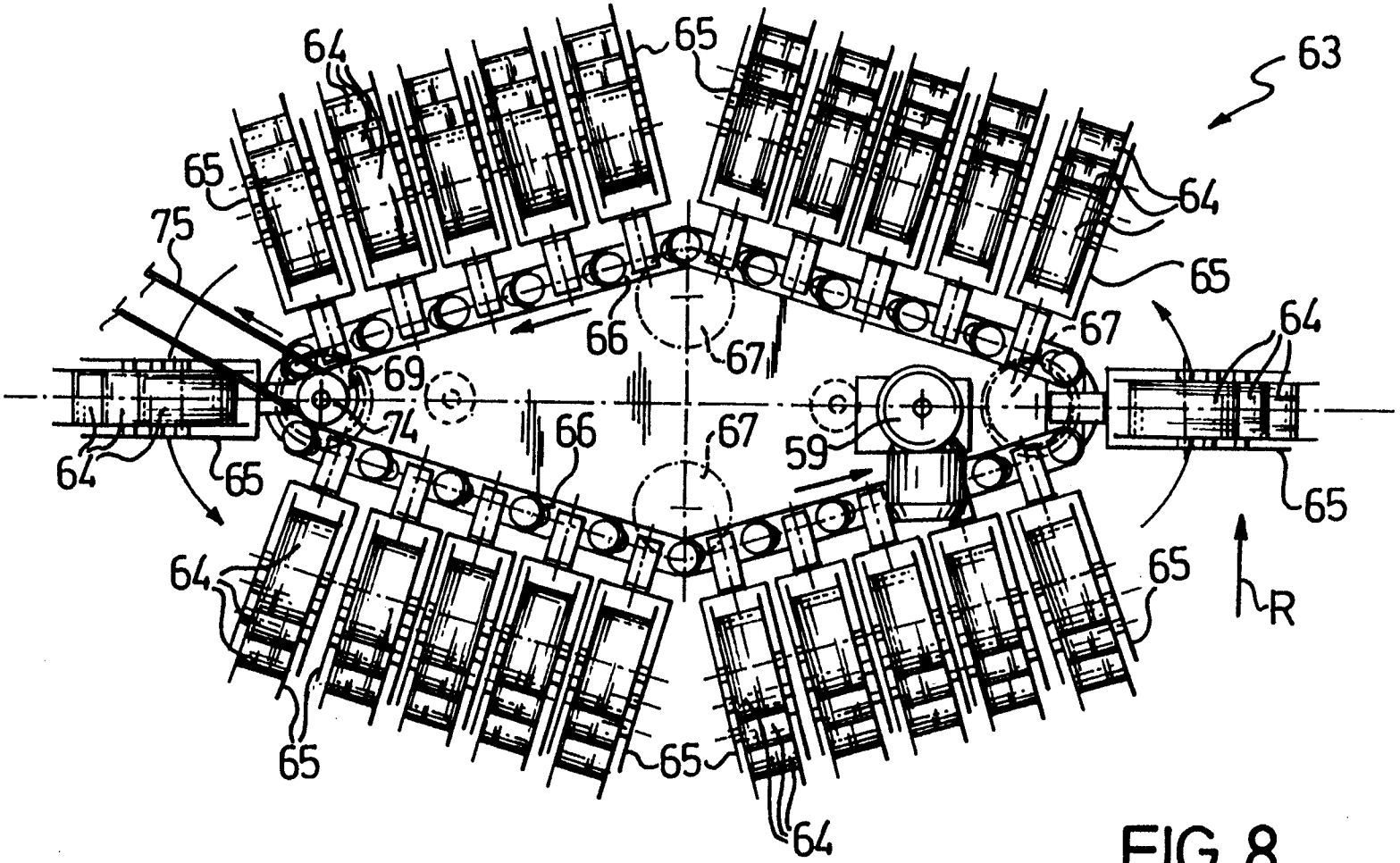
FIG. 8 is a top plan view of certain upper parts of the machine in FIG. 2.
Figure 9:
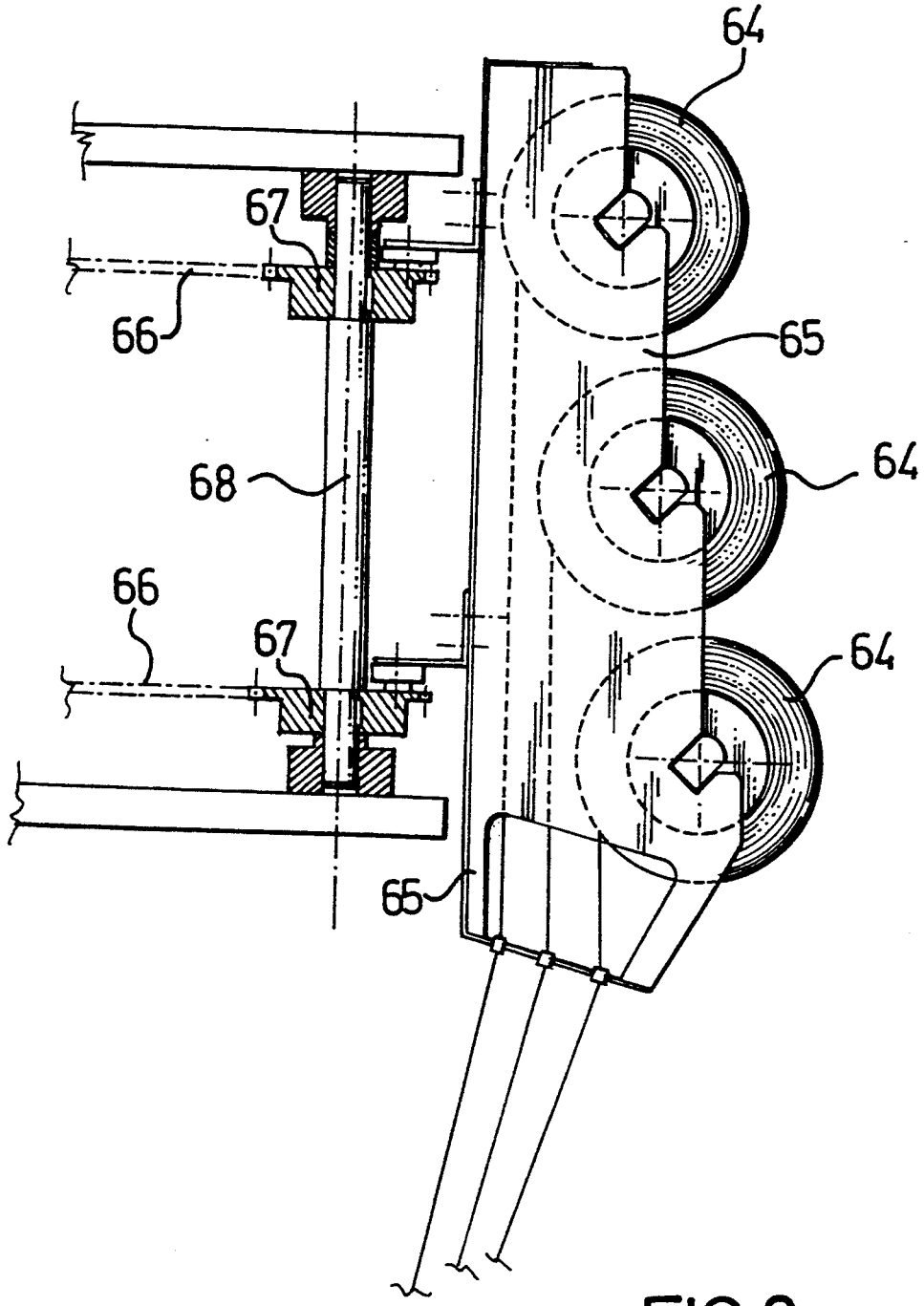
FIG. 9 shows a detail of FIG. 8, viewed in the direction of arrow R.

With reference to FIG. 6, assuming for the chain 53 the direction of rotation indicated by the arrow, it can be appreciated that the bias yarns E move stepwise in the right-to-left direction, whereas the yarns F move stepwise in the left-to-right direction while crossing one another. Each bias yarn in a set of bias yarns E or F, on reaching its respective fabric end, turns around its respective wheel 55 or 57 to the opposite side, thereby becoming the first yarn to be tied in the other set of bias yarns.

Whereas the chain 53 is moved stepwise, the carousel 63 is moved of continuous motion but in any case appropriate to keep the reels 64 corresponding to the respective eyelets 54 in the plates 52.

In order for the bias yarns E, F to lie at a 45-degree angle to the warp yarns A, B and the weft yarns C, D, the formed fabric T is pulled by means of the sand roll such that it will move forward a distance equal to the pitch distance between the warp yarns A and the warp yarns B.

Mounted on the two arms 16 is also a reed 78 which is effective, once the weft yarn C is inserted, to hold the warp yarns A separated and urge said weft yarn C close against the previously formed fabric; likewise, on the two arms 31, there is mounted a reed 79 which is effective, once the weft yarn D is inserted, to hold the warp yarns B separated and to urge said weft yarn D close against the previously formed fabric. The reeds 78, 79 are driven by grooved wheels 80 fast with the shaft 20 and coaxial with the wheels 21; the drive arrangement is similar to that previously reviewed for operating the bar 11 with the needles 12 and the bar 26 with the needles 27 and will not, therefore, be explained in detail here.

The machine as described and illustrated is simple in construction and effective in operation.

The guide means for the bias yarns E, F, which enable such bias yarns to be woven, meet in particular this demand for simplicity and functionality.

The particular lozenge-like shape of the carousel 63 path compensates for tension differences as the inclination of the bias yarns E, F changes, especially as such bias yarns move from one straight section to the other of the endless path of the chain 53.

It is understood that variations of and/or additions to what has been described and illustrated in the foregoing are possible.

As for the fabric of FIG. 1, the inclination of the bias yarns E, F can be changed. The rate of the weft yarns C, D may also be varied, e.g. two or more consecutive weft yarns C and/or D may be thought of.

As for the machine, the various guide, support, drive, transfer and timing members may be replaced with equivalent devices. The pickers 36, 37 may be replaced with equivalent means for inserting the weft yarn; for example, a single picker may be thought of which would move between two parallel positions aligned to the two sheds formed between the warp yarns; alternatively, an arrangement of one or more shuttles could be used. The carousel 63 may be driven stepwise like the underlying plates 52 with the eyelets 54.

If the rate of the weft yarns C and D changes across the fabric, then the two pickers 36, 37 would obviously have to be driven to suit, such that each picker either inserts one or more respective weft yarns, or inserts no weft yarns at all during each weaving cycle, again according to that rate.

The yarns to be used for forming the fabric may, of course, be in any forms, dimensions and materials.

Figure 10:
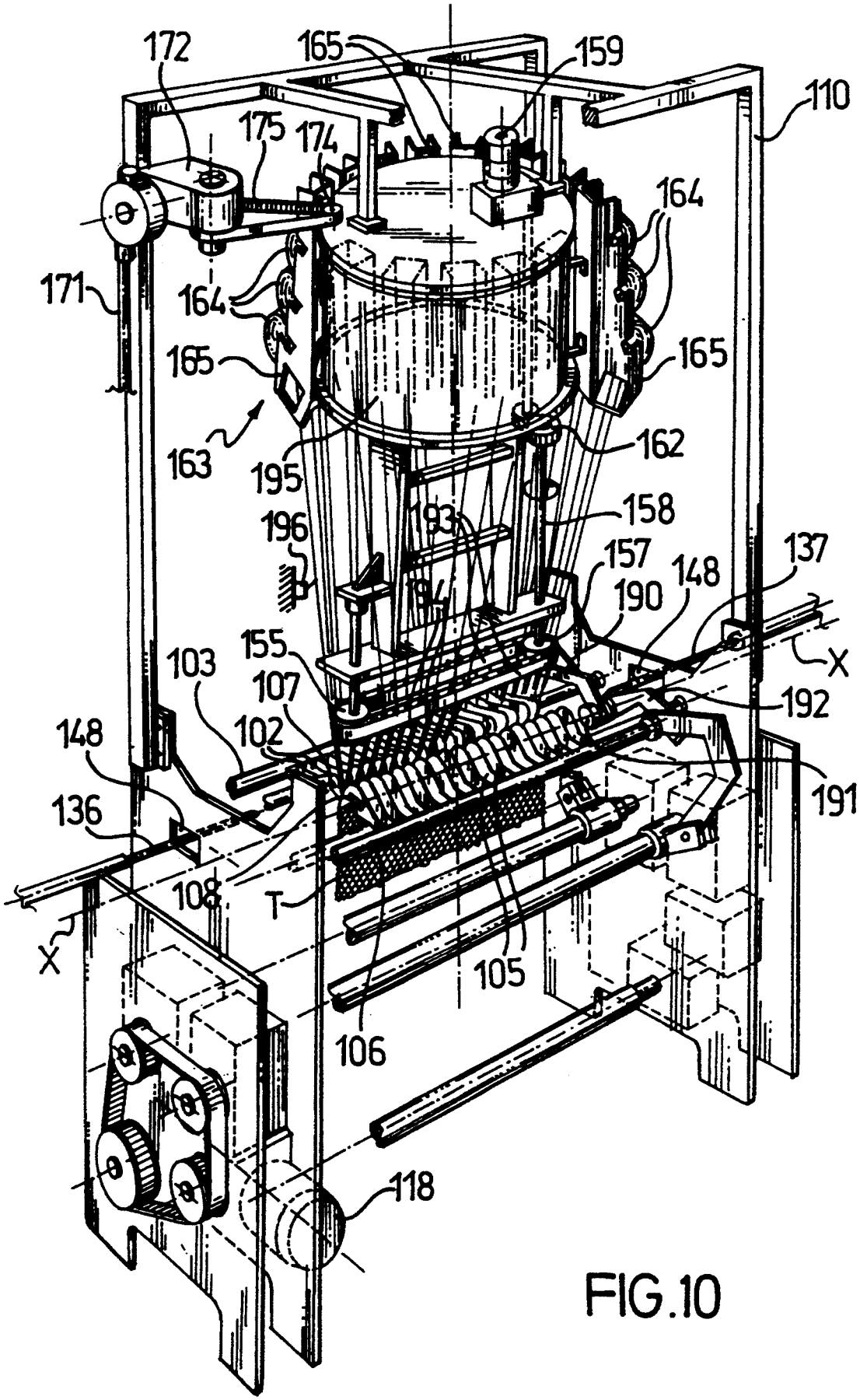
FIG. 10 is a perspective view of another weaving machine for making the tetraxial fabric in FIG. 1.

The other weaving machine for manufacturing the fabric of FIG. 1, illustrated in FIG. 10, differs from the weaving machine illustrated in FIG. 2 mainly in the means for guiding the warp yarns A,B toward the fabric formation area and in the means for guiding the bias yarns E,F toward the fabric formation area.

The machine of FIG. 2 will be called thereinafter first machine and the machine of FIG. 10 second machine.

In the second machine the same or equivalent elements of the first machine are indicated with the same reference numbers increased by hundred.

Instead of the needles 12,27 of the first machine, in the second machine two sets of curved guide tubes are provided, through each tube of which a respective warp yarn is passed. With reference to each guide member of the warp yarns, the tubes are rigidly carried by a set of respective plates parallel one to the other and mounted on a common holder rod; the tubes, plates and rod of the first guide member for the warp yarns A are indicated with 101,102,103 respectively; the tubes, plates and rod of the second guiding member for the warp yarns B are indicated with 104,105,106 respectively. The plates 102,105 have each a notch indicated with 107 for the plates 102 and with 108 for the plate 105. The rod 103 is borne at each end by an arm 190, which arm at one end is rigidly connected to the rod 103 and at the other end is pivotally coupled to a fixed pivot 191; the rod 106 is correspondingly borne at each end by an arm 192, which arm at one end is rigidly connected to the rod 106 and at the other end is pivotally coupled to said fixed pivot 191. The fixed pivots 191 of the arms 190,192 are disposed along an axis X corresponding to the starting position Z of the formed fabric T. The two rods 103,106 are each reciprocated rotatively about the pivots 191, as in the first machine the bars 11,26 are reciprocated rotatively about the shafts 17,32 respectively; such rods 103,106 are driven by the main electric motor 118 through kinematic means analogous to that described for the first machine.

As regards the guide means for the bias yarns E,F, in the second machine, instead of the chain 53 of the first machine a cogged belt 193 is provided, and instead of the plates 52 with the eyelets 54 a set of straight guide tubes 194 is provided. Each guide tube 194 is fixed to the cogged belt 193 in the cavity between two consecutive cogs and each bias yarn is passed through a respective of said guide tubes 194. Clearly, instead of the sprocket wheels 55,57 provided for the chain 53 of the first machine, two cogged pulleys 155,157 are provided around which the cogged belt 193 is wound.

In the upper portion of the second machine a feeder unit for the bias yarns E,F is provided comprising a carousel 163 as in the first machine. However in the carousel 163 the box-type holder elements 165 are moved according to a circular path; for this purpose a drum 195 is provided which carries all the box-type holder elements 165 with the reels 164. The drum 195 is driven rotatably about its axis by the electric motor 118 through the shaft 171, the drive unit 172, the cogged drive belt 175 and the cogged wheel 174; the connection between the cogged wheel 174 and the drum 195 can be made through a gear, driven by such cogged wheel 174, which meshes with a crown gear of the drum 195.

The second machine provides also a tension compensator 196 of known type applied to each bias yarn between the respective reel 164 and the respective guide tube 194.

The pickers 136,137 of the second machine are disposed at opposite sides instead of being disposed at the same side like in the first machine.

The second machine substantially operates as the first machine. The detail view of FIG. 12 corresponds to the detail view of FIG. 5. In the FIGS. 11,13 the rod 106 has been rotated toward the rod 103 and a shed has been formed through which a weft yarn C is inserted by means of the picker 136.

Figure 11:
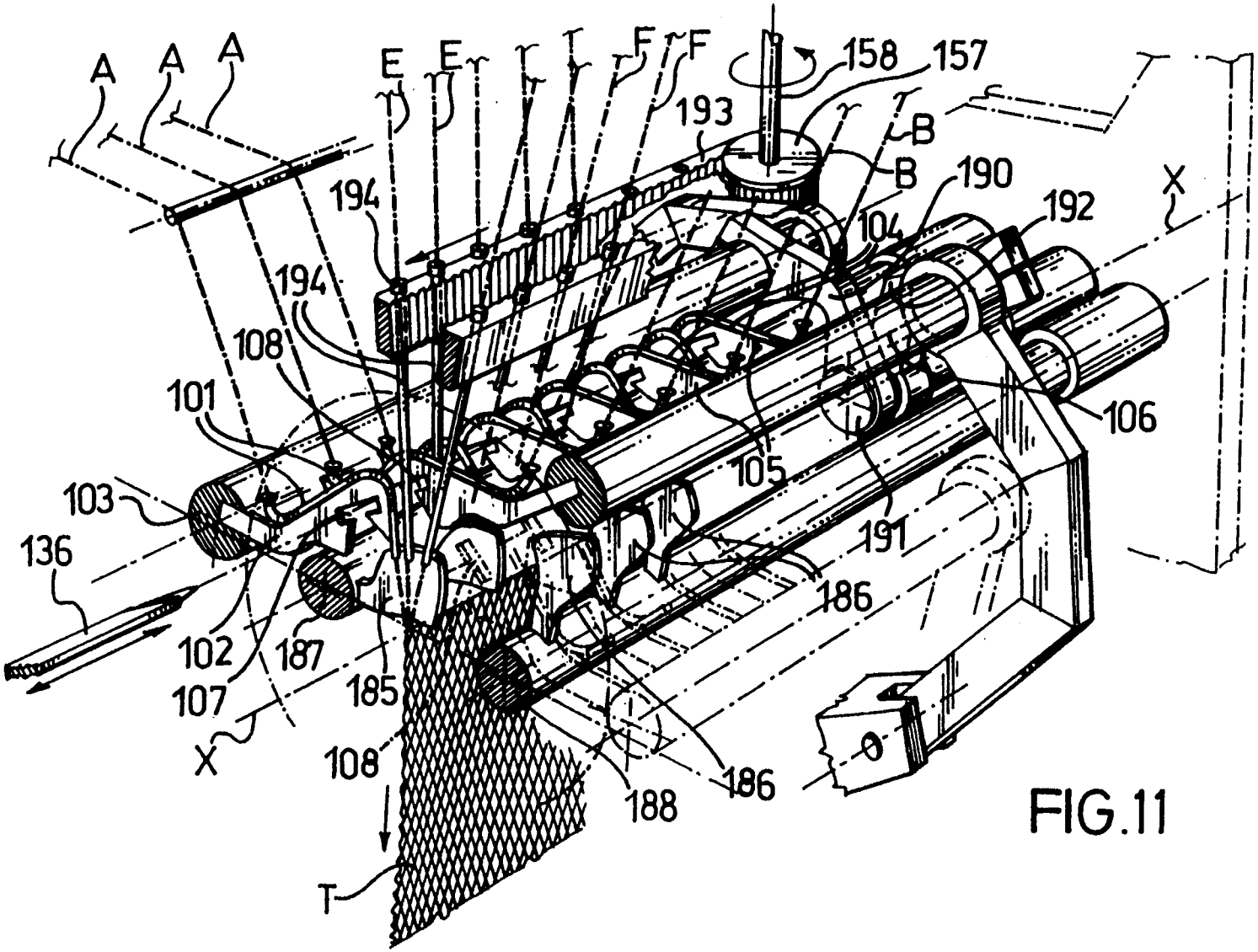
FIG. 11 is an enlarged detail view of FIG. 10, relating to a specific operative position of the weaving machine.
Figure 12:
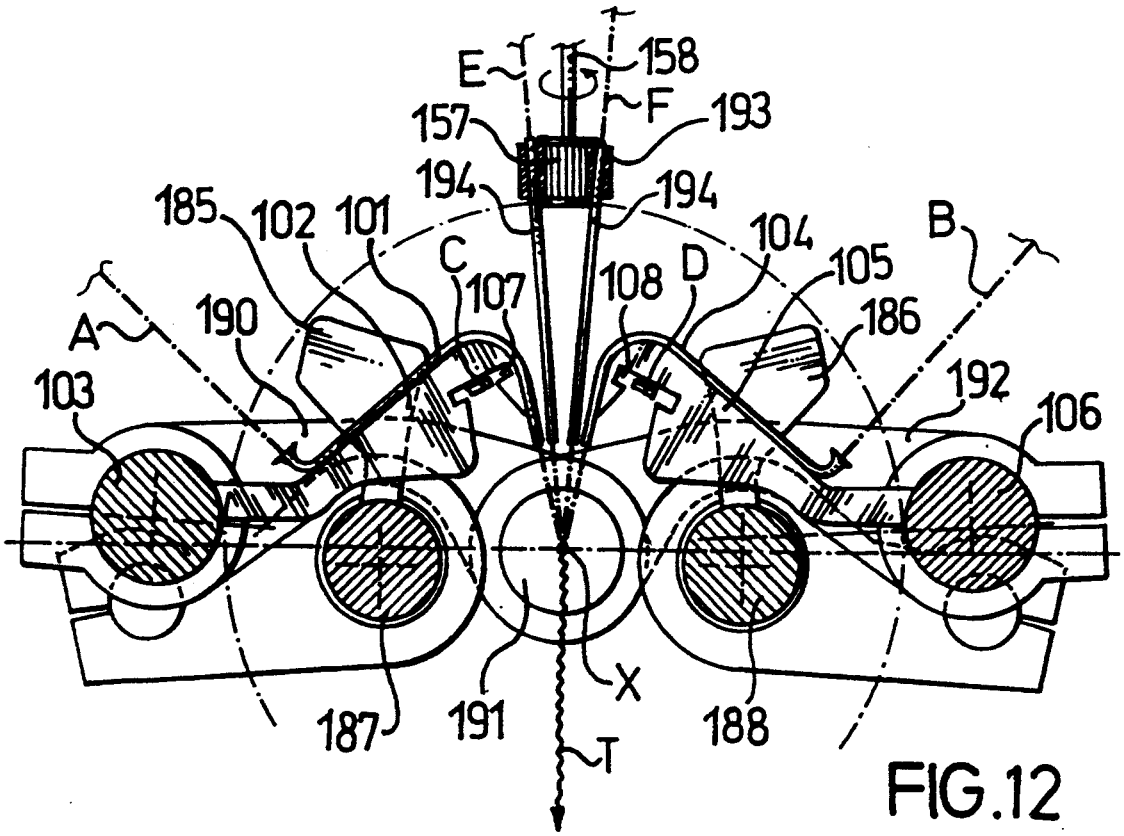
FIGS. 12,13 show the operation of the weaving machine of FIG. 10 with reference to the detail of FIG. 11.
Figure 13:
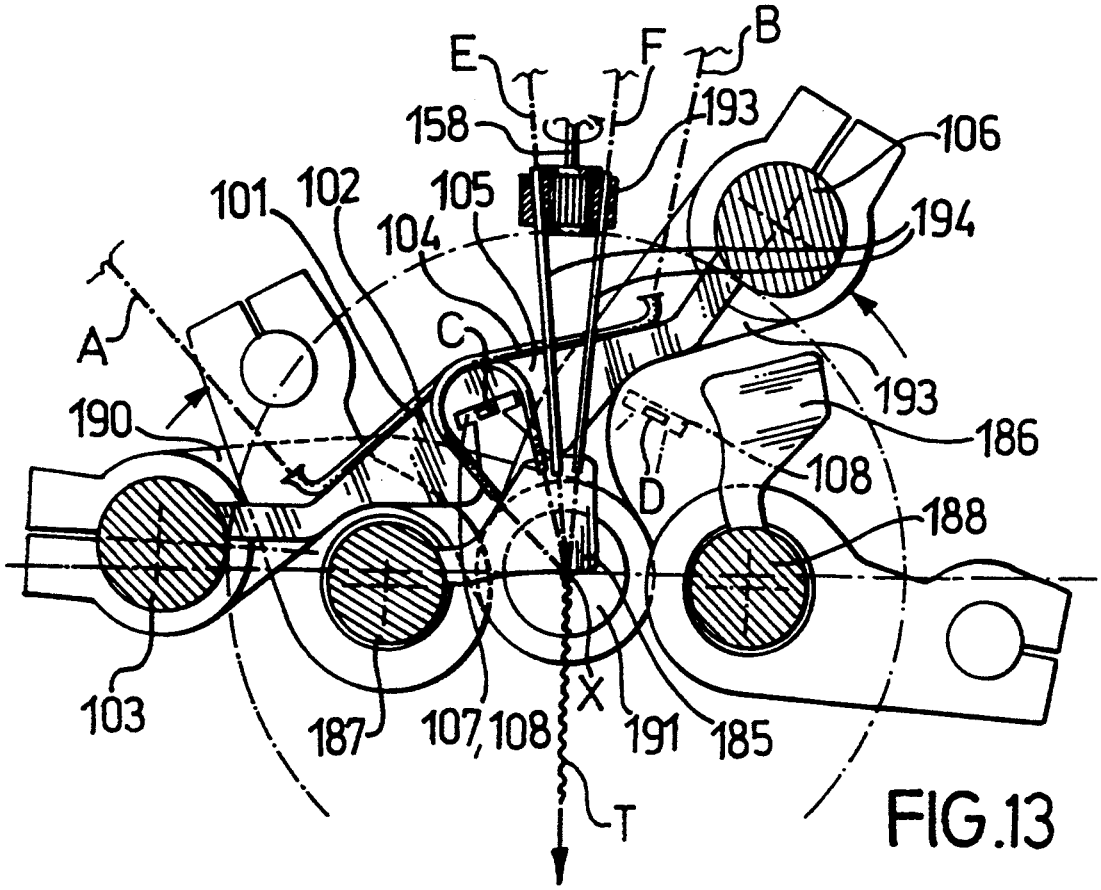

When the guide means for the warp yarns A,B in the second machine are reciprocally disposed so as to form the first or the second shed through which a weft yarn, C or D, is inserted by the picker, all the notches 107,108 of the plates 102,105 are aligned to form a passage and guide for the picker, as shown in the FIGS. 11,13.

The function of the two reeds 78,79 of the first machine is performed in the second machine by two set of plates 185,186. The plates 185,186 are mounted on respective holder shafts 187,188 each mounted on the bearing structure 110 and reciprocated rotatively about its axis. The plates 185,186 and the shafts 187,188 are not shown in FIG. 10 but only in the FIGS. 11,12,13.

The described second machine offers several advantages.

The guide tubes 101,104,194 permit to guide each yarn nearly up to the crisscross point. In this way interference and therefore rubbing among the yarns is prevented. Moreover, an accurate distribution of the yarns and therefore a high uniformity of the fabric is guaranteed. The use of the guide tubes permits also to obtain a fabric having a high fineness.

The plates 102,105 constitute a rigid support for the guide tubes 101,104 respectively. Moreover, as seen above, the notches 107,108 of such plates 102,105 guide the pickers during the insertion of the weft yarns. There is also to point out that the plates 102,105 constitute guides for the plates 185,186 during the movement of these latter, in order to avoid rubbing on the yarns.

The rods 103,106 with the respective plates 102,105 and tubes 101,104, the shafts 187,188 with the respective plates 185,186, the cogged belt 193 with the guide tubes 194, may all be easy assembled and disassembled, and therefore each component may be easy changed for instance when the weaving machine must be prepared for making a fabric of a different fineness.

The feature that the arms 190,192, which bear the bars 103,106 respectively, are hinged around the axis X corresponding to the starting position Z of the formed fabric T, prevents shortening or lengthening of the warp yarns.

Both in the first and in the second weaving machine, instead of the reels 64 and 164 other yarn storing devices, for instance yarn beams, could be used.

It cannot be excluded in the first machine the use of a carousel rotating about its axis.

I claim:

1. A tetraxial fabric, comprising: warp yarns, weft yarns, and first bias yarns and second bias yarns, the first and second bias yarns crisscrossing each other, and the warp and weft yarns, along two opposite diagonal directions, wherein a first set of the warp yarns is overlaid by the weft yarns and, in turn, overlies the first and the second bias yarns, and that a second set of the warp yarns, which alternate with and lie parallel to the warp yarns in the first set, overlies the weft yarns and is, in turn, overlaid by the first and the second bias yarns.

2. A tetraxial fabric according to claim 1, wherein the first and the second bias yarns crisscross along two mutually orthogonal directions.

3. A tetraxial fabric according to claim 2, wherein the first and the second bias yarns are set at an angle of 45° to the warp yarns and the weft yarns.

4. A tetraxial fabric according to claim 3, wherein the crossovers of all the yarns occur at common crossover points, and at each of the common crossover points each of the yarns cross one of the warp yarns, one of the weft yarns, one of the first bias yarns, and one of the second bias yarns.

5. A weaving machine for manufacturing fabric having warp yarns, weft yarns, and bias yarns comprising:

means for guiding the warp yarns toward a fabric formation area;

means for passing the weft yarns through a shed of the warp yarns in the fabric formation area;

means for guiding the bias yarns in the fabric formation area such that the bias yarns cross each other and the warp and the weft yarns along two opposite diagonal directions, wherein the means for guiding the warp yarns comprises:

a first guide member for guiding a first set of the warp yarns; and a second guide member for guiding a second set of the warp yarns in an offset fashion from the first set of the warp yarns; means for providing the first and second guide members at juxtaposed locations to each other;

means for moving each of the first and second guide members between a rearward position where their respective set of the warp yarns locate to one side relative to the bias yarns and the other set of the warp yarns, and a forward position where their respective set of the warp yarns locate to the opposite side from the bias yarns and the other set of the warp yarns;

means for forming a first shed for one of the weft yarns between the first set of the warp yarns under the guiding action of the first guide member in the forward position and the second set of the warp yarns under the guiding action of the second guide member in the rearward position; and means for forming a second shed for another one of the weft yarns between the first set of the warp yarns under the guiding action of the first guide member in the rearward position and the second set of the warp yarns under the guiding action of the second guide member in the forward position.

6. A weaving machine according to claim 5, wherein each of the guide members comprises a set of needles mounted in a common holder, each of the needles being formed with a hole through which a respective one of the warp yarns is passed.

7. A weaving machine according to claim 6, further comprising means for reciprocating the holder of the needles rotatively to move the warp yarns between the rearward position and the forward position.

8. A weaving machine according to claim 7, wherein the means for guiding the bias yarns comprises a set of guide elements moved by stepwise motion around an endless path, each of the guide elements being provided with an eyelet through which a respective one of the bias yarns is passed.

9. A weaving machine according to claim 7, further comprising: two reeds; and means for rotatively reciprocating the reeds, each reed, once a respective weft yarn is inserted by the passing means, holding a respective set of warp yarns separated and urging the weft yarn close against the previously formed fabric.

10. A weaving machine according to claim 8, wherein the guide elements are attached to a chain driven around an endless path.

11. A weaving machine according to claim 8, wherein at the location of the guide elements there is provided a carousel to transport, in timed relationship with the movement of the guide elements, a plurality of yarn storing devices from each of which one or more yarns extend which are passed through the eyelets in the respective guide elements.

12. A weaving machine according to claim 11, wherein the guide elements are transported around an elongate endless path with two straight sections and two circular arc sections interconnecting the two straight sections, and wherein the carousel transports the yarn storing devices around a substantially lozenge-like path, with the acute angles of the lozenge being located at the circular arc sections.

13. A weaving machine according to claim 8, further comprising timing means for generating weaving cycles and for controlling sequentially for each of the weaving cycles:

means for moving the first guide member to the forward position and for holding the second guide member in the rearward position to form the first shed through the warp yarns;

means for inserting a weft yarn through the first shed;

means for moving the first guide member to the rearward position;

means for moving the guide elements for the bias yarns forward one step;

means for moving the second guide member to the forward position and for holding the first guide member in the rearward position to form the second shed through the warp yarns;

means for inserting another weft yarn through the second shed;

means for moving the second guide member to the rearward position; and means for moving the guide elements for the bias yarns forward one step.

14. A weaving machine according to claim 5, further comprising two insertion members for the weft yarns, each at a respective one of the two sheds that form between the warp yarns.

15. A weaving machine according to claim 5, wherein each of the guide members comprises a set of guide tubes rigidly carried by a set of respective plates parallel one to the other and mounted on a common holder, through each guide tube being passed a respective warp yarn.

16. A weaving machine according to claim 15, further comprising means for reciprocating the holder of the plates rotatively along an axis corresponding to the starting position of the formed fabric, to move the warp yarns between the rearward position and the forward position.

17. A weaving machine according to claim 16, wherein:

the means for reciprocating further comprises means for placing the plates in a position corresponding to the formation of the first shed or the second shed; and the plates have each a notch, all the notches being aligned to form a passage for the means for passing the weft yarns when the plates of the two set of plates are in the position corresponding to the formation of the first shed or the second shed.

18. A weaving machine according to claim 17, wherein the means for guiding the bias yarns comprises a set of guide tubes moved by stepwise motion around an endless path, through each guide tube being passed a respective bias yarn.

19. A weaving machine according to claim 18, wherein the guide tubes are attached to a cogged belt driven around an endless path.

20. A weaving machine according to claim 18, wherein at the location of the guide tubes there is provided a carousel to transport, in timed relationship with the movement of the guide tubes, a plurality of yarn storing devices from which one or more yarns extend which are passed through the respective guide tubes.

21. A weaving machine according to claim 20, further comprising means for moving the carousel rotatably about its axis.

22. A weaving machine according to claim 17, further comprising:

two sets of plates mounted on two respective common holders; and means for rotatively reciprocating the common holders, each set of plates, once a respective weft yarn is inserted by the passing means, holding a respective set of warp yarns separated and urging the weft yarn close against the previously formed fabric.

* * * * *